US005354054A

United States Patent [19]

Akatsuka et al.

[11] Patent Number: 5,354,054

[45] Date of Patent: Oct. 11, 1994

[54] GOLF CLUB AND GOLF CLUB SET

[75] Inventors: Tsuneo Akatsuka, Saitama; Yoshihiro Motoki, Misato; Takashi Harada, Soka; Akira Suzawa, Koshigaya, all of Japan

[73] Assignee: Somar Corporation, Japan

[21] Appl. No.: 145,561

[22] Filed: Nov. 4, 1993

[30] Foreign Application Priority Data

Mar. 31, 1993 [JP] Japan ..... 5-096780

[51] Int. Cl.[5] ..... A63B 53/00

[52] U.S. Cl. ..... 273/77 A; 273/80 C; 273/167 G; 273/175

[58] Field of Search ..... 273/77 R, 77 A, 80 B, 273/80 C, 80.2, 167F, 167 G, 167 J, 169, 175

[56] References Cited

U.S. PATENT DOCUMENTS

| | | | |
|---|---|---|---|
| 1,497,578 | 6/1924 | Mothersele | 273/167 F |
| 1,516,786 | 11/1924 | Prentiss | 273/77 A |
| 1,594,801 | 8/1926 | Stackpole | 273/77 A |
| 3,473,370 | 10/1969 | Marciniak | 273/77 A |
| 4,762,322 | 8/1988 | Molitor et al. | 273/77 A |
| 4,840,380 | 6/1989 | Kajita et al. | 273/77 A |
| 5,271,620 | 12/1993 | Moriguchi et al. | 273/167 F |

*Primary Examiner*—William H. Grieb
*Attorney, Agent, or Firm*—Lorusso & Loud

[57] ABSTRACT

A golf club having a club number in the range of Nos. 1 through 5 and including a club shaft, and a head connected to one end thereof and having the center of mass located below the half face height. The club head includes a top surface, a sole disposed opposite to the top surface, a toe portion, a heel portion opposite to the toe portion, a front, impact face located between the toe and heel portions, a rear portion located opposite to the face and between the toe and heel portions. The toe and rear portions together form a smooth, continuous, enlarged side surface so that an upper section of the club head above the horizontal center plane, which passes the half height of the face portion, has a volume smaller than that of a lower section of the club head below the horizontal center plane. The club shaft has not greater than 2 g/in. of a ratio of the weight thereof to the length thereof and a kick point located at a position spaced apart from the one end a distance equal to 44% or more of the total length thereof.

4 Claims, 3 Drawing Sheets

GOLF CLUB AND GOLF CLUB SET

BACKGROUND OF THE INVENTION

1. Field of the Invention

This invention relates to a golf club and to a golf club set.

2. Description of Prior Art

One known wood club head is shown in FIGS. 5 and 6 of the accompanying drawings. The golf club head includes a crown, top surface 2, a bottom surface or sole 7 disposed opposite to the top surface 2, a toe portion 5, a heel portion 6 opposite to the toe portion 5, a front portion 3 having a flat impact face and located between the toe and heel portions, a rear portion 4 located opposite to the front portion 3 between the toe and heel portions. Each of the toe portion 5, heel portion 6, front portion 3 and rear portion 4 is integral with the top surface 2 and with the bottom surface 7 so that an upper, smooth, continuous ridge 8 is formed between the top surface 2 and toe, heel, front and rear portions and a lower, smooth, continuous ridge 9 is formed between the bottom surface 7 and toe, heel, front and rear portions.

The toe and rear portions 5 and 4 form a smooth, continuous, side surface inwardly inclined at an angle $\theta_1$ relative to the vertical line when viewed on the toe as shown in FIG. 5 and at an angle $\theta_2$ relative to the vertical line on the head-on view of FIG. 6. This structure of the conventional golf club head results in the center of gravity shifted toward the top surface 2. From the standpoint of distance of shot, however, it is desirable that the center of gravity be low. Thus, a weight is mounted in a lower portion of the club head and/or the thickness of the sole is increased to lower the center of gravity.

On the other hand, there is an increasing demand for a wood club head having such a large volume as to provide an increased area of sweet spot. In this respect, the known club head is disadvantageous since an increase in volume results in the upward shift of the center of gravity and since a heavier weight or a thicker wall must be used.

With a club having a long, steel club shaft, average amateur players generally encounter a difficulty in obtaining long distance because the ball trajectory is low. To cope with this problem, a long club has been developed with a shaft made of a fiber-reinforced plastic, having a kick point located near to the head and having head with a smaller loft angle as compared with the standard value. With this club, the ball trajectory becomes high so that the distance of flight is increased. However, with such a known club it is difficult to control the direction of the shot.

SUMMARY OF THE INVENTION

The present invention provides a golf club having a club number in the range of Nos. 1 through 5 and including a club shaft, and a head connected to one end of the club shaft. The head includes a top surface, a sole disposed opposite the top surface, a toe portion, a heel portion opposite the toe portion, a front, impact face located between the toe and heel portions, a rear portion located opposite the face and between the toe and heel portions. The toe and rear portions form a smooth, continuous, enlarged side surface so that an upper section of the club head above the horizontal center plane, which passes through the half height of the face portion, has a volume smaller than that of a lower section of the club head below the horizontal center plane. The club shaft has weight to length ratio of not greater than 2 g/in and a kick point located at a position spaced apart from the one end a distance equal to 44% or more of the total length thereof.

The present invention also provides a golf club set including five golf clubs with club numbers of No. 1 through No. 5. Each of the golf clubs includes a club shaft, and a head connected to one end of the club shaft. The club shaft of each of the golf clubs has a weight to length ratio of not greater than 2 g/in and a kick point located at a position spaced apart from the one end a distance equal to 44% or more of the total length thereof. The loft angle and weight of the head of each of the golf clubs increase as the club number increases while the volume of the head of each of the golf clubs decreases as the club number increases. The loft angle, weight and volume of the heads of Nos. 1–5 golf clubs are in the following ranges:

| Club Number | Loft Angle | Weight | Volume |
|---|---|---|---|
| 1 | 8–12 degrees | 190–220 g | 160–220 cc |
| 2 | 10–15 degrees | 200–230 g | 150–210 cc |
| 3 | 12–18 degrees | 200–230 g | 150–200 cc |
| 4 | 15–21 degrees | 210–240 g | 140–180 cc |
| 5 | 18–24 degrees | 220–250 g | 130–160 cc |

The terms used herein are in accordance with "GOLF CLUB DESIGN, FITTING, ALTERATION AND REPAIR, the principles and procedures" by Ralph Maltby, 2nd edition published in May 1982 by Ralph Maltby Enterprises, Inc., U.S.A. and the following terms mean as follows:

Center of Gravity: center of mass and/or the location where all balance points intersect;

Face: the hitting surface of a wood club;

Face Bulge: the radius of curvature of the face in the horizontal direction;

Face Roll: the radius of curvature of the face in the vertical direction;

Face Angle: the angle of the face relative to the grounded sole line with the shaft hole being oriented in the direction perpendicular to the line of ball flight (plus value: closed or hook face angle, minus value: open or slice face angle);

Vertical Face Center Plane: the vertical plane which includes the sole line;

Half Face Height: a height equal to $\frac{1}{2}$ of the height of the face on the vertical face center plane;

Horizontal Face Center Plane: the horizontal plane at the half face height;

Heel: that portion of a club head where the sole and the hosel meet;

Hosel: that portion of a club head designed to interfit with the shaft;

Loft: the angle of the face relative to a line perpendicular to the sole (angle R in FIG. 8);

Sole: the bottom surface of a club head that rests on the ground when the club is held in the hitting position. The sole may be flat or slightly concave but is generally cambered;

Sole line: the line on the ground in the direction from front to back at which the cambered sole contacts the ground when the club is rested on its sole in the hitting position;

Toe: that portion of a club head that is farthest away from the hosel;

Lie: the angle of the centerline of the shaft relative to the ground line with the ground line being tangent to the sole at the face center plane;

Wood: a club head, not necessarily made of wood, having a loft angle less than 24.

Club length: the distance from the back heel portion of the sole to the top of the shaft ($L_0$ in FIG. 7, the grip cap is not taken into account);

Shaft length: the total distance between both ends of the shaft ($L_1$ in FIG. 7);

Kick point: the point of a golf club shaft at which the angle of curvature is minimum when the shaft is bent by applying an axial stress at both ends thereof;

Club number: the number of an golf club contained in a set of golf clubs with different club lengths and loft angles. The club number (N) and club length ($L_0$) have the following relationship: $L_0$ (in.)=L (in.)−0.5N (in.) wherein L is constant in a given set of golf clubs and is in the range of 42–45 inches.

It is an object of the present invention to provide a long club which gives a long shot distance.

Another object of the present invention is to provide an club of the above-mentioned type which gives intended shot direction.

It is a further object of the present invention to provide a club of the above-mentioned type which provides a large sweet spot and, therefore, an improved meet (initial ball speed/head speed).

BRIEF DESCRIPTION OF THE DRAWINGS

Other objects, features and advantages of the present invention will become apparent from the detailed description of the preferred embodiment of the invention which follows, when considered in the light of the accompanying drawings, in which.

DETAILED DESCRIPTION OF THE PREFERRED EMBODIMENT OF THE INVENTION

Figure 1:
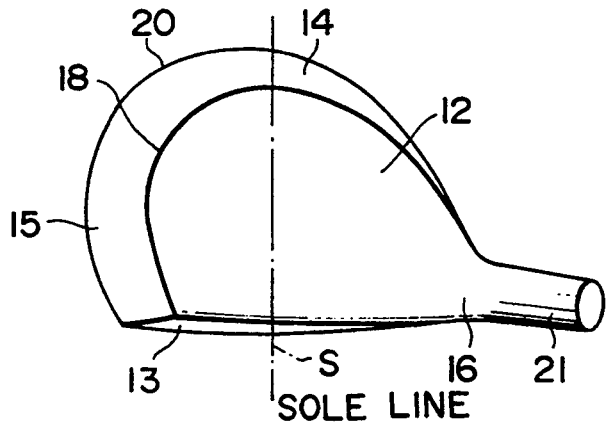
FIG. 1 is a plan view showing one embodiment of wood club head according to the present invention rested on its sole in the designated playing position.

Referring now to FIGS. 1–4, the club head of this invention includes a top surface 12, a sole (bottom surface) 17 disposed opposite to the top surface 12, a toe portion 15, a heel portion 16 opposite to the toe portion, a front, face portion 13 serving as an impact surface and located between the toe and heel portions 15 and 16, a rear portion 14 located opposite to the face portion 13 between the toe and heel portions 15 and 16. The heel portion 16 has a hosel 21 to be connected to a club shaft (not shown).

The toe portion 15, heel portion 16, face portion 13 and rear portion 14 are integral with the top surface 12 and with the bottom surface 17 so that upper and lower, smooth, continuous ridges 18 and 19 are formed between the top surface 12 and the toe, heel, front and rear portions and between the bottom surface 17 and the toe, heel, front and rear portions, respectively.

The toe and rear portions 15 and 14 together form a smooth, continuous, enlarged side surface such that an upper section X of the club head above the horizontal center plane C, which passes through the half height of the face portion 13, has a volume smaller than that of a lower section Y of the club head below the center plane C. The volume of the upper section includes that of the hosel 21. Preferably, the volume ratio of the upper section to the lower section is between 30:70 to 45:55.

Figure 2:
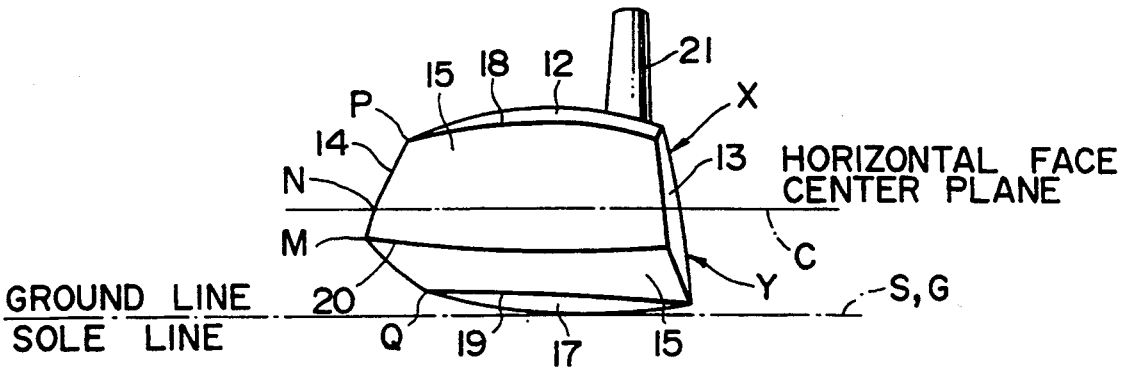
FIG. 2 is a side, toe-on view of the club head of FIG. 1.
Figure 3:
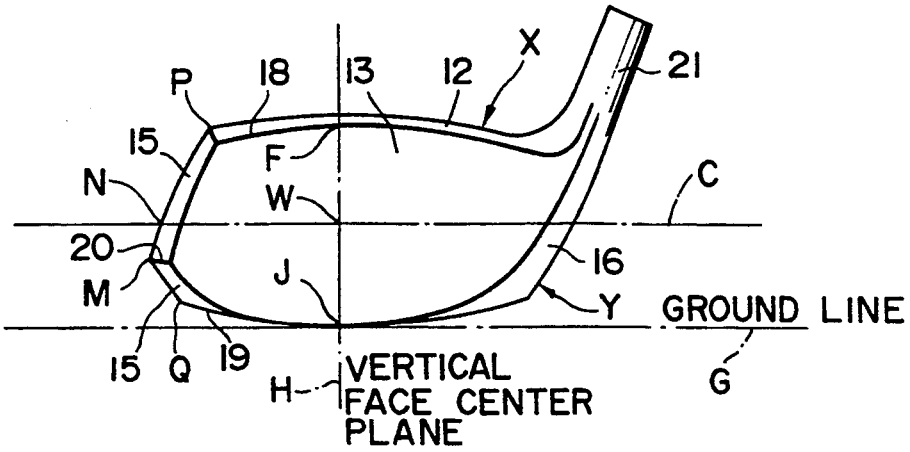
FIG. 3 is a front, face-on view of the club head of FIG. 1.
Figure 4:
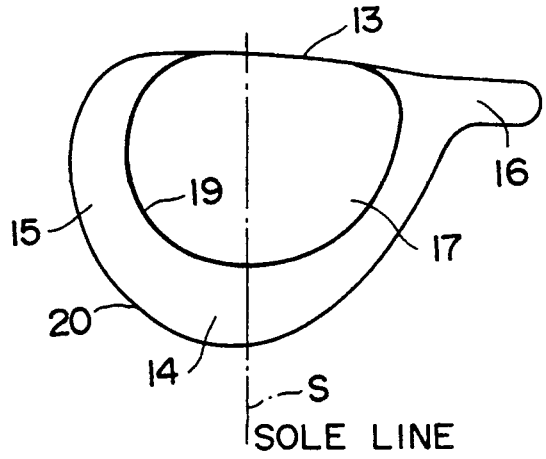
FIG. 4 is a bottom, sole-on view of the club head of FIG. 1.
Figure 5:
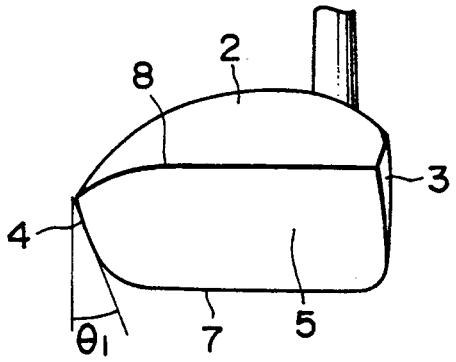
FIG. 5 PRIOR ART
FIG. 5 is a toe-on view, similar to FIG. 2, showing conventional club head.
Figure 6:
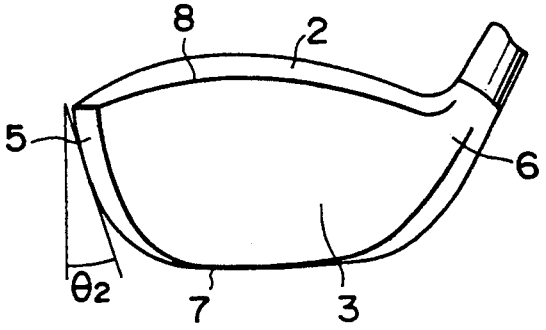
FIG. 6 PRIOR ART
FIG. 6 is a face-on view, similar to FIG. 3, of the club head of FIG. 5.

The center plane C is horizontal when the club is rested on its head in the hitting position as shown in FIGS. 1–3 and passes through a midpoint W (FIG. 3) between points F and J of the upper and lower edges 18 and 19 of the face 13. The distance between the points F and J is referred to as face height and the midpoint W represents half face height. These points F, J and W on the face 13 exist on a vertical, face center plane H on which the sole line S lies. The cambered sole 17 contacts the ground G at the sole line S.

Preferably, the enlarged side surface formed by the toe and rear portions 15 and 14 has a maximum enlarged portion 20 located below the center plane C but above the lower ridge 19. Thus, as shown in toe-on view of FIG. 2, the contour of the back portion 14 is a C-shaped line protruding outward in an intermediate portion. The protrusion is maximum at the point M. The point P at which the contour line meets the upper ridge 18 and the point Q at which the contour line meets the lower ridge 19 are located inward (rightward) from the point M. This also applies to the face-on view of FIG. 3 and to any other intermediate view through 90 degree rotation between the toe-on and face-on views. In this case, the point M is always located below the point N at which the contour line crosses the center plane C.

The club head according to the present invention may be suitably formed from a metal shell, such as of stainless steel or titanium, packed with a suitable packing material such as a polyurethane foam. The wall thickness is, for example, about 3 mm in the front portion 13, about 1–2 mm in the top, toe, back and heel portions and about 5 mm in the bottom portion 17. The club head may also be formed of wood or a fiber-reinforced plastic, if desired. The face angle of the club head is in the range of −2° to plus 1°. The face bulge and face roll are each generally in the range of 8–14 inches.

Figure 7:
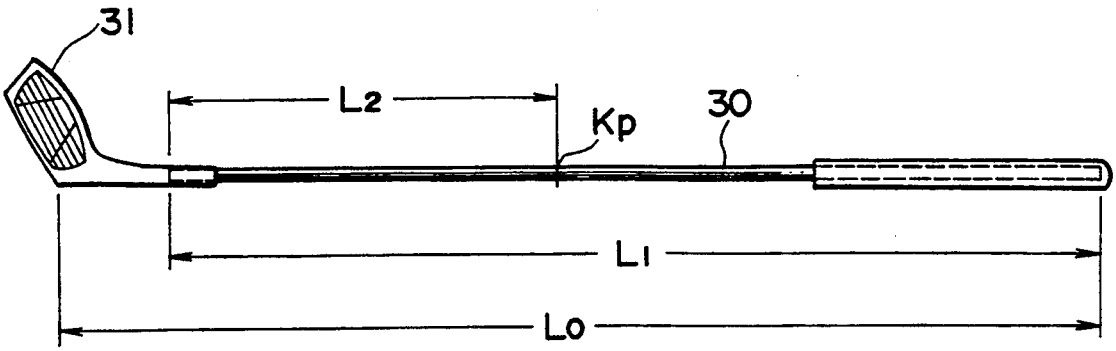
FIG. 7 a side view diagrammatically illustrating one embodiment of a club according to the present invention.
Figure 8:
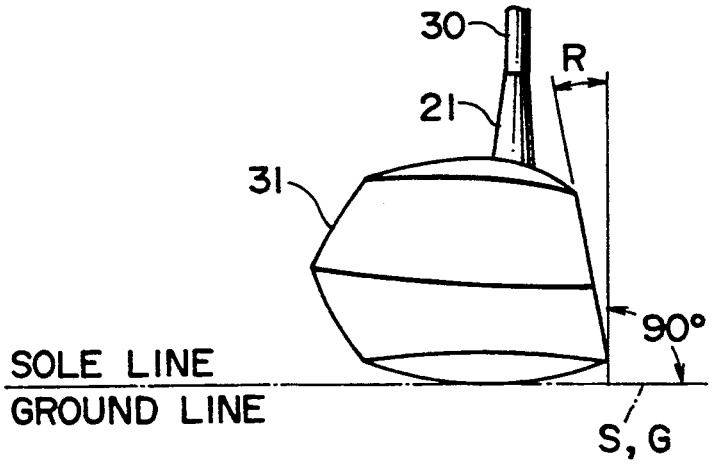
FIG. 8 is a fragmentary, enlarged front view of the club head of FIG. 7.

Referring to FIGS. 7 and 8, a golf club according to the present invention has a club number in the range of Nos. 1 through 5 and comprises a club shaft 30, and a head 31 connected to one end of the club shaft 30. The head 31 has the construction described in the foregoing.

The club shaft 30 has a ratio ($W_1/L_1$) of the weight $W_1$ thereof to the length $L_1$ thereof of not greater than 2 g/in. (gram per inch), preferably 1.4–2.0 g/in. When the ratio $W_1/L_1$ exceeds 2 g/in., the weight of the shaft is too heavy to be satisfactorily swung, unless a light weight club head is used. The use of a light weight club head, however, is not advantageous because the head speed becomes slow. The club shaft 30 having the above-specified ratio $W_1/L_1$ permits an easy and desirable swing so that the head speed can be increased, i.e. the distance of shot can be increased.

The club shaft 30 is formed of a fiber-reinforced plastic. As the resin, a thermosetting resin such as an epoxy resin is suitably employed. The reinforcing fibers which are dispersed in the matrix of the resin may be, for example, carbon fibers. The carbon fibers may be used in conjunction with other fibers such as boron fibers, aromatic polyamide fibers (Kevlar fibers), titanium fibers or glass fibers, if desired. The club shaft 30 may be prepared from a prepreg composed of the above-described fibers impregnated with the above-described matrix resin by any suitable known method such as a sheet winding method and a filament winding method. The filament winding method is preferred because no seams are formed.

The club shaft 30 has a kick point $K_p$ located so that the distance $L_2$ from the tip end thereof to the point $K_p$ is equal to 44% or more, preferably 46–49%, of the total length $L_1$ thereof, namely $L_2 \geqq 0.44L_1$, preferably $0.46L_1 \leqq L_2 \leqq 0.49L_1$. By locating the kick point of the club shaft 30 at a position within the above-specified range, precision of the direction of shot is improved.

Table 1 below shows specifications of an example of golf club set according to the present invention. The kick point $K_p$ and center of gravity $G_s$ of the shaft are expressed in terms of percentages of the distance from the tip end of the shaft to the total length of the shaft.

TABLE 1

| Club Number | Club Length $L_0$ (in.) | Shaft Length $L_1$ (in.) | Shaft Weight $W_1$ (g) | Kick Point $K_p$ (%) | Center of Gravity $G_s$ (%) | Loft Angle R (°) | Head Weight $W_2$ (g) |
|---|---|---|---|---|---|---|---|
| 1 | 43.5 | 42.0 | 63 | 46 | 54 | 11 | 208 |
| 2 | 43.0 | 41.5 | 62 | 46 | 54 | 13 | 215 |
| 3 | 42.5 | 41.0 | 61 | 47 | 54 | 16 | 222 |
| 4 | 42.0 | 40.5 | 60 | 47 | 54 | 18 | 229 |
| 5 | 41.5 | 40.0 | 59 | 47 | 54 | 22 | 236 |

The following examples will further illustrate the present invention.

EXAMPLE 1

A #1 club having the specifications shown in Table 2 was prepared using a head having a structure shown in FIGS. 1–4 and a fiber-reinforced plastic shaft having a length ($L_1$) of 42 inches, a weight ($W_1$) of 53.3 g, a weight per unit length ($W_1/L_1$) of 1.27 g/in., and a kick point located at a position spaced apart from the front end a distance equal to 42% of the length ($L_1$) thereof. The shaft was tapered and was prepared by the filament winding method using medium modulus, high strength carbon fiber (6000 filaments) as reinforcing fibers and a thermosetting epoxy resin composition as a matrix resin and had diameters of 8.5 mm at the front end and 15.2 mm at the grip end. The kick point of the shaft was measured by the ordinary method in which a predetermined load was applied in the direction axial to the shaft to determine the maximum flexture point. To this shaft, a royal grip (52 g) was attached at the grip end while a head was fitted at the front end. A total of 5 g of an adhesive was used for the attachment of the grip and the head.

The club was attached to a commercially available robot hitting machine (manufactured by Miyamae Co., Ltd.) and ten balls were hit with a head speed of 40 m/second. The balls used for the hitting test were ALTAS PRO 500 (manufactured by Bridgestone Inc.). Each shot was analyzed by a shot analyzer (Science Eye, manufactured by Bridgestone Sports Inc.). The results (average of ten shots) are summarized in Table 2.

EXAMPLES 2–4

Example 1 was repeated in the same manner as described except that shafts having the characteristics shown in Table 2 were used. The heads used in Examples 1–4 were the same except the head weight. In Example 4, the shaft used was prepared by sheet winding rather than filament winding. The results are shown in Table 2.

Comparative Example

Example 1 was repeated in the same manner as described except that a steel shaft having the characteristics shown in Table 2 was substituted for the fiber-reinforced plastic shaft. The head used was the same as those of the above examples except the head weight. The results are shown in Table 2. The head weight of each of the golf clubs of Examples 1–4 and in Comparative Example is so adjusted as to provide a lorythmic swingweight (14 inch fulcrum) of D0.

TABLE 2

| Example | 1 | 2 | 3 | 4 | Comptv. |
|---|---|---|---|---|---|
| Club | | | | | |
| Club number | #1 | #1 | #1 | #1 | #1 |
| Weight $W_0$ (g) | 321 | 328 | 343 | 323 | 362 |
| Length $L_0$ (in.) | 43.5 | 43.5 | 43.5 | 43.5 | 43.5 |
| Shaft | | | | | |
| Length $L_1$ (in.) | 42 | 42 | 42 | 42 | 42 |
| Weight $W_1$ (g) | 53.3 | 62.6 | 84.0 | 55.9 | 110 |
| $L_1/W_1$ (g/in.) | 1.27 | 1.49 | 2.0 | 1.33 | 2.62 |
| Kick point (%) | 45 | 46 | 47 | 46 | 47 |
| Center of Gravity $G_s$ (%) | 56 | 54 | 52 | 52 | 50 |
| Head | | | | | |
| Loft angle R (°) | 11.5 | 11.5 | 11.5 | 11.5 | 11.5 |
| Weight $W_2$ (g) | 211 | 208 | 202 | 210 | 195 |
| Volume (cc) | 186 | 186 | 186 | 186 | 186 |
| Face angle | +1.0 | +1.0 | +1.0 | +1.0 | +1.0 |
| Lie angle | 55 | 55 | 55 | 55 | 55 |
| Face bulge (in.) | 11 | 11 | 11 | 11 | 11 |
| Face roll (in.) | 17 | 17 | 17 | 17 | 17 |
| Shot | | | | | |
| Head speed (m/sec.) | 40 | 40 | 40 | 40 | 40 |
| Ball speed (m/sec.) | 57 | 58 | 58 | 58 | 58 |
| Meet ratio | 1.42 | 1.46 | 1.42 | 1.46 | 1.40 |
| Carry distance (m) | 185 | 186 | 174 | 187 | 165 |
| Total shot distance (m) | 205 | 210 | 205 | 209 | 201 |
| Shot direction | | | | | |
| Upward direction (°) | 11 | 9 | 9 | 10 | 8 |
| Sideward direction (°) | 0 | 0 | 0 | 0 | 0 |
| Maximum flight height (m) | 23 | 17 | 15 | 21 | 13 |
| Deviation from centerline (m) | 5 | 2 | 3 | 4 | 3 |

From the results shown in Table 2, it will be appreciated that the club of the present invention gives a higher meet ratio (ball speed/head speed) and longer carry and shot distances while maintaining the deviation of shot in a satisfactory range.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A golf club having a club number in the range of Nos. 1 through 5 and comprising a club shaft, and a head connected to one end of said club shaft, said head comprising a top surface, a sole disposed opposite said top surface, a toe portion, a heel portion opposite said toe portion, a front, impact face located between said toe and heel portions, a rear portion located opposite said face and between said toe and heel portions, said toe and rear portions forming a smooth, continuous, enlarged side surface so that an upper section of said club head above the horizontal center plane, which passes through the half height of said face portion, has a volume smaller than that of a lower section of said club head below said horizontal center plane, said club shaft having not greater than 2 g/in. of a ratio of the weight thereof to the length thereof, said club shaft having a kick point located at a position spaced apart from said one end a distance equal to 44% or more of the total length thereof.

2. A golf club as claimed in claim 1, wherein the major portion of said inflated side enlarged surface is located below said horizontal center plane.

3. A golf club as claimed in claim 1, wherein the volume ratio of said upper section to said lower section is between 30:70 to 45:55.

4. A golf club set comprising five golf clubs with club numbers of No. 1 through No. 5, each of said golf clubs including a club shaft, and a head connected to one end of said club shaft, the club shaft of each of said golf clubs having not greater than 2 g/in. of a ratio of the weight thereof to the length thereof and a kick point located at a position spaced apart from said one end a distance equal to 44% or more of the total length thereof, the loft angle and weight of the head of each of said golf clubs increasing as the club number increases while the volume of the head of each of said golf clubs decreasing as the club number increases, the loft angle, weight and volume of the heads of said golf clubs being in the following ranges:

| Club Number | Loft Angle | Weight | Volume |
|---|---|---|---|
| 1 | 8–12 degrees | 190–220 g | 160–220 cc |
| 2 | 10–15 degrees | 200–230 g | 150–210 cc |
| 3 | 12–18 degrees | 200–230 g | 150–200 cc |
| 4 | 15–21 degrees | 210–240 g | 140–180 cc |
| 5 | 18–24 degrees | 220–250 g | 130–160 cc. |

* * * * *